United States Patent [19]

Goldman

[11] Patent Number: 4,679,341

[45] Date of Patent: Jul. 14, 1987

[54] MODULAR DISPLAY APPARATUS FOR SIGN PANELS

[75] Inventor: John G. Goldman, Northbrook, Ill.

[73] Assignee: Mercury Plastics, Inc., Chicago, Ill.

[21] Appl. No.: 698,570

[22] Filed: Feb. 6, 1985

[51] Int. Cl.[4] ..... G09F 7/02

[52] U.S. Cl. ..... 40/611; 40/605; 40/490; 40/156; 40/152; 40/10 R

[58] Field of Search ..... 40/159, 16.4, 611, 605, 40/156, 618, 152, 489, 16.2, 10 R, 152.1, 490, 491, 465

[56] References Cited

U.S. PATENT DOCUMENTS

| | | | |
|---|---|---|---|
| 1,094,709 | 4/1914 | Faucett . | |
| 1,571,771 | 2/1926 | Fischer | 40/611 |
| 1,720,328 | 7/1929 | Henderson | 40/611 |
| 1,964,484 | 6/1934 | Schroeder | 40/611 |
| 2,162,025 | 6/1939 | McClaughry | 40/611 |
| 2,288,570 | 6/1942 | Mungen | 40/63 |
| 2,785,487 | 3/1957 | Hopp | 40/16.4 |
| 3,015,897 | 1/1962 | Hopp | 40/11 |
| 3,371,439 | 3/1968 | Smith et al. | 40/156 |
| 3,381,401 | 5/1968 | Fuller, Jr. | 40/159 |
| 4,001,957 | 1/1977 | de Lima Castro | 40/10 R |
| 4,094,085 | 6/1978 | Nolan, Jr. | 40/152.1 |
| 4,377,049 | 3/1982 | Simon et al. | 40/465 |

*Primary Examiner*—Gene Mancene
*Assistant Examiner*—J. Hakomaki
*Attorney, Agent, or Firm*—Dick and Harris

[57] ABSTRACT

A modular display apparatus for receiving and displaying sign panels, in which panel support elements cooperate with elevated ridges and frame overlay members to form sign panel regions in which the sign panels may be deployed. Panel insert slots are formed at one end of the panel sign region where no elevated ridge is positioned, through the overlay of a frame strut; the insert slot serving as an insertion aperture for the facilitated receipt and/or removal of the sign panel. A back cover plate member is integrated into the support panel and insert locking devices are provided to maintain the sign panel in place, within the sign display region, by precluding inadvertent removal through the insert slot. A "stepped" or staggered configuration of a number of such sign panels as well as a back-lit light transmitting embodiment are further described.

15 Claims, 10 Drawing Figures

MODULAR DISPLAY APPARATUS FOR SIGN PANELS

BACKGROUND OF THE INVENTION

The present invention relates in general to advertising and/or information sign apparata and in particular to a modular display apparata for slidably receiving, maintaining and displaying sign panels in a facilitated, desired, structural orientation.

For decades, various means have been utilized to display signage panels in a myriad of retail enviroments as a principle point-of-purchase marketing tool. While the vast majority of such display devices typically involve permanent or semi-permanent attachment of a sign panel to a frame element so as to display the sign panel in a "framed" environment, some devices have been directed to the utilization of removable and insertable signage panels that appear to be permanent but, in fact, are replaceable, at will, into a finished frame of display. Among the prior art devices relying upon and/or disclosing utilization of "slide in" - type signage panels are U.S. Pat. Nos. 1,094,709; 2,288,570; 3,015,897; 4,001,957; 4,094,085; and, 4,377,049. In spite of these relatively recent developments in "slide in" signage panels and the like, few, if any, conventional devices address a structure or display apparatus for cooperation with signage panels, where the display apparatus is modular in construction so as to afford benefits heretofore unrealized by the prior art.

It is thus an object of the present invention to provide a modular display apparatus for signage panels which is relatively inexpensive to fabricate through the facilitated overlay of a relatively flat apparatus components—where the components themselves are fabricated into three dimensional, aesthetically pleasing shapes through low cost manufacturing techniques including, but not limited to, vacuum-forming techniques.

It is additionally an object of the invention to preclude the need for the relatively expensive structure and installation effort required in more conventional "permanent" types of point-of-purchase displays through a structure that facilitates the insertion and removal of signage panels into a framed "finished" environment.

As an additional object of the invention is the fabrication of a modular display apparatus in which panel display regions are formed through adhesive or welded attachment of aligned subparts, modular subparts that create the illusion of a substantially costly box frame device without involving the materials or efforts required by such conventional box frame apparata.

Another object of the invention is to provide a modular display apparatus of such a structure which is flexible to alteration to accommodate, for example, the staggered placement of signage panels, as desired or, to alternatively permit an illuminated "back-lit" display medium.

These and other objects of the invention will become apparent in light of the present specification and drawings.

SUMMARY OF THE INVENTION

The present invention comprises a modular display apparatus for slidably receiving, maintaining and displaying one or more flat multi-sided signage panels in a desired orientation. The apparatus comprises one or more substantially flat panel supports for positioning behind corresponding ones of the substantially flat signage panels in an environment in which each of the flat panel support means is of a size substantially equivalent to that of the flat signage panel positioned in front of it. A plurality of elevated panel ridge means operably affixed to the panel support means emanate forwardly therefrom (towards an past the position of the signage panel), with this plurality of elevated panel ridges positioned to closely follow the outer peripheral edge of the respective signage panel so as to substantially abut all but one of the signage panel's sides.

The plurality of elevated panel ridges serves to restrain the position of the signage panel positioned therewithin in juxtaposition to the respective panel support as well as one about which all but one nonabutted side are surrounded so as to enable slidable reciprocating movement of the signage panel into and out of abutment with the plurality or elevated panel ridges.

Overlay frame means are operably affixed over the flat panel support, the plurality of elevated panel ridges and a peripheral portion of the signage panel to further restrainably affix and border each one of the one or more signage panels in place against respective ones of the flat panel support means, as well as within respective ones of the abutted elevated panel ridges. This overlay frame describes a series of panel apertures with each aperture being operably aligned with the respective one of the one or more signage panels, so as to operably display the indicia borne by the signage panel through the aperture itself, and further comprises a series of overlay struts framing each of the panel apertures—where each of the structural struts is of a substantially inverted U-shaped construction. Each of the overlay struts is in respective operable alignment with each of the plurality of elevated panel ridges so as to telescopically nest over same while framing all the peripheral sides of the signage panel positioned therewithin (and behind). The overlay frame further creates, at the location of the nonabutting panel ridge section, a slot insert means which is formed between the substantially flat panel support means at that location as well as formed by the corresponding overlay strut positioned thereover, to accommodate the insertion and restraint of the signage panel into its desired orientation for display—with the signage panel restrainably interposed between the panel support means along its rear surface, the overlay frame means about its periphery at its front surface, and the elevated panel ridges abutting all but one of the signage panel peripheral sides. Furthermore the overlay frame means are restrainably affixed to one or more of the elevated panel ridge means and the panel support means by overlay attachment means.

In a preferred embodiment of the invention the apparatus further comprises back cover means comprising a back plate member which is operably attached to the rear surface of the substantially flat panel support member towards improving the overall structural rigidity of the display apparatus. Preferably, the substantially flat panel support means includes a rearwardly facing continuous flange element with the back plate member being capable of being telescopically recieved by the continuous flange member so as to be flushly positionable within the back of the panel support itself. The back plate member is restrainably affixed in place within the flange member through back plate attachment means.

In the preferred embodiment of the invention the plurality of elevated panel ridges are integrally formed with and emanate from a single sheet of material embodying the panel support means, where both the panel support means and the panel ridge are vacuum-formed from a single sheet of panel support material. Additionally, in this preferred embodiment the overlay frame means comprises an integrated overlay frame member fabricated from a single sheet of overlay frame material, again, comparably through the vacuum-forming process. Regardless of how the panel support means and the elevated panel ridges are formed, it is contemplated that the signage panels, the panel support means, elevated panel ridge means and overlay frame means (together with the aperture means formed therewithin) are of a substantially equivalent rectangular geometric shape.

In various embodiments of the invention the apparatus further includes insert locking means for precluding the inadvertent release of any of the signage panels through the respective slot insert means, in view of the absence of an abutting elevated panel ridge at that location. In one such embodiment, the insert locking means comprises an elevated shoulder region rising from the lowermost abutting elevated panel ridge where the elevated shoulder region is positioned substantially proximate to the slot insert to block release of the signage panel after the panel slides past the elevated shoulder region. The shoulder region accordingly restrains the signage panel in place within the modular display apparatus. In yet another embodiment the insert locking means comprises a locking tab which emanates inwardly from the lower side of the overlay frame strut member positioned immediately over the slot insert region. In this embodiment the locking tab snaps back into close proximity to the panel support means directly below it, behind the signage panel, after the signage panel has been slid past the locking tab—so as to restrain the signage panel in place within the modular display apparatus.

In the preferred embodiment of the invention the elevated panel ridges about each of the signage panels are substantially continuous in shape with an interruption in the continuity of the shape occurring at the location of the slot insert means. Additonally the aligned frame overlay means is equivalently continuous in shape so as to form a closed frame member about and in front of respective ones of the signage panels, while camouflaging the interruption in the aligned elevated panel ridge means at the slot insert means. Additionally the depth of the frame overlay is substantially shorter than that of the elevated panel ridge so as to permit the nesting of the frame overlay along the upper region or "crest" of the respective aligned panel ridge while creating and forming the slot insert means at the point of interruption in the substantially continuous elevated panel ridge. In this preferred embodiment, the differences in the depth of the frame overlay means and the elevated panel ridge means is of a dimension deep enough to accommodate the sliding receipt or "passage" of the signage panel therewithin the slot insert means.

The invention contemplates overlay attachment means as alternatively comprising a curable adhesive material or the utilization of sonic welds, either of which may be used to effectuate attachment between the overlay frame and one or more of the elevated panel ridge or panel support elements.

It is contemplated that the apparatus may involve the display of the plurality of several substantially flat signage panels. In one embodiment where a plurality of flat signage panels are displayed, one or more of this plurality of substantially flat signage panels have respective slot insertion means positioned relative to the respective panel supports so as to enable slidable reciprocating insertion (and/or removal) of the signage panel into the modular display apparatus, at a plurality of different directions. In such an embodiment, for example, one rectangular panel support region would have slot insert means positioned at the right to accommodate insertion of the signage panel from the right while another next to it accommadates insertion of its signage panel from the top and, the one next to it accommodates insertion of its respective signage panel from the left. In another embodiment in which a plurality of signage panels are utilized, one or more of the signage panels are positoned in front of panel support means which themselves are positioned along different planar depths in the modular display apparatus so as to create a "stepped" display arrangement.

In yet another embodiment of the invention, the panel support means and the non-indicia portions of the signage panels are formed of a substantially translucent material in order the enable the overall display apparatus to further cooperate with background illumination means—to in turn be capable of transmitting light through the translucent panel support and signage panels to create a lighted display.

DETAILED DESCRIPTION OF THE DRAWINGS

Figure 2:
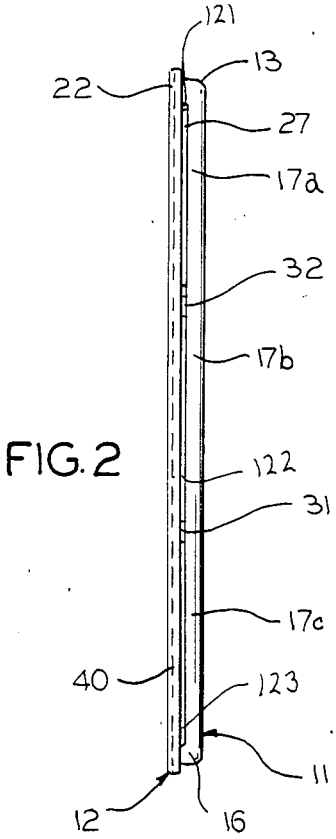
FIG. 2 of the drawings is a right side elevational view of the modular display apparatus of FIG. 1 showing the relationship of the structural elements upon articulation of the device.

While this invention is susceptible of embodiment in many different forms, there is shown in the drawings and will herein be described in detail, several specific embodiments, with the understanding that the present disclosure is to be considered as an exemplification of the principles of the invention and is not intended to limit the invention to the embodiments illustrated.

Figure 1:
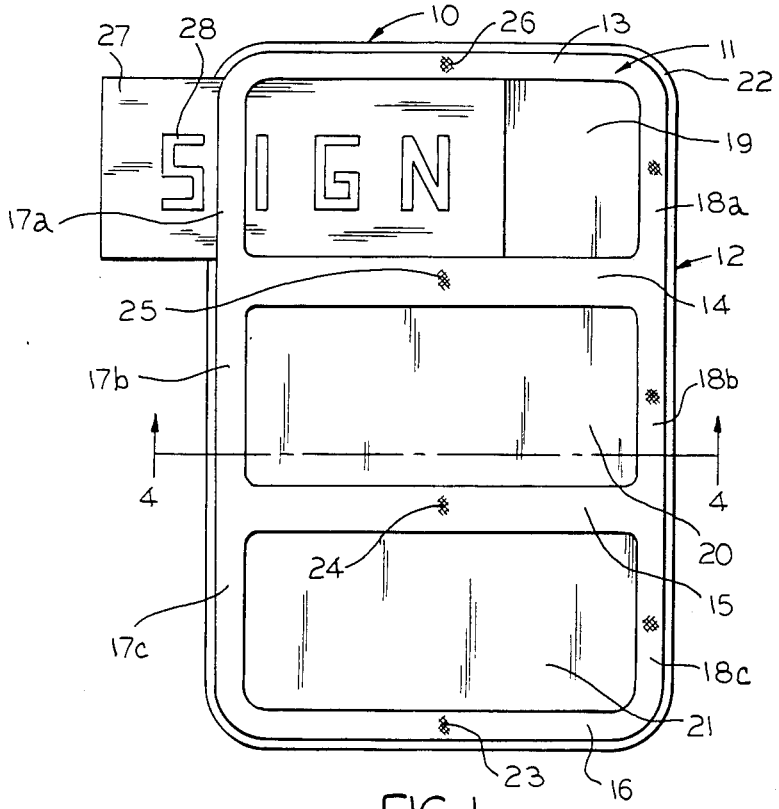
FIG. 1 of the drawings is a front elevational view of the modular display apparatus showing, in particular, placement of the signage panel within a panel region formed by the panel support means, elevated ridges and frame overlay.

Modular display apparatus 10 is shown in FIG. 1 as comprising panel support regions 19, 20 and 21, as well as panel support lip 22—all part of panel support means 12. Also shown is frame overlay means 11 comprising frame overlay segments 13 through 16, 17*a*, *b* and *c*, and 18*a*, *b* and *c*, signage panel 27 with indicia 28 as well as overlay attachment means 23 through 26, here comprising sonic welds affixed between frame overlay 11 and the elevated panel ridges thereunder, as shown in FIGS. 2 through 4.

Frame overlay segments 13, 17*a*, 17*b*, 17*c* and 16 in frame overlay means 11 are also shown in FIG. 2 together with panel support means 12, panel support flange - lip 22 and back cover plate 40 which is shown telescopically nesting within panel support flange 22. Also shown in FIG. 2 are signage panel 27, elevated panel ridges 31 and 32 and insert slots 121 through 123 formed between panel support means 12 and frame overlay means 11.

Figure 3:
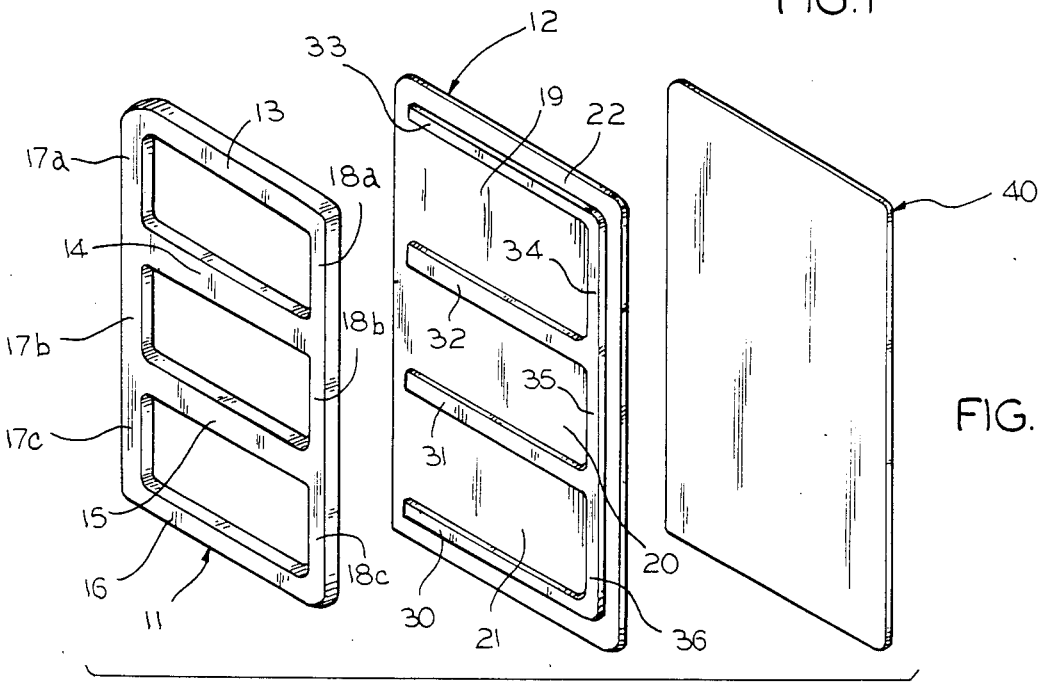
FIG. 3 is an exploded perspective view from the top and side of the display apparatus displaying, in unarticulated form, Applicant's panel support means, elevated panel ridges and frame overlay means for integration into the overall display apparatus.

The modular display apparatus of FIGS. 1 and 2 is shown in exploded perspective view in FIG. 3 which particularly discloses panel support means 12 with flanged lip 22 having support regions 19, 20 and 21 formed thereupon and which further includes preferrably vacuum-formed emanating elevated panel ridges 30 through 36 forming three separate respective panel insert regions in which one end of each is unabutted by a ridge formation. Frame overlay means 11 is again, preferrably, formed of a single sheet of vacuum-formed material (such as styrene) in which overlay segment struts 13 through 16, 17*a*, 17*b*, 17*c*, 18*a*, 18*b* and 18*c* are formed to create substantially rectangular overlay apertures for direct alignment with panel support sections 19, 20 and 21, respectively, and particularly with the signage panel means sandwichable therebetween. Also shown is back plate 40 for insertion within flange 22 of panel support means 12. While vacuum-forming is contemplated for formation of the various structural elements including the panel support means 12, its associated emanating elevated ridges such as ridge 32, as well as frame overlay means 11, preferrably of a sstyrene plastic, it should be realized that various other materials and/or forms of construction thereof are contemplated by the invention.

Figure 4:
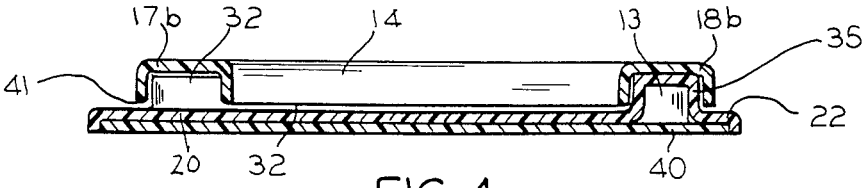
FIG. 4 is an elevated cross-sectional view taken along lines 4-4 and looking in the direction of the arrows, showing the structural nesting relationship of the above-mentioned structural elements.

The apparatus of FIGS. 1 through 3 is additionally shown in cross-section in FIG. 4 in which frame overlay strut 14, having a substantially inverted U-shaped construction, is shown nesting atop elevated ridge 32 together with the cross-sectional views of overlay segments 17*b* and 18*b*. Back plate 40 is additionally shown in place within panel support means flange 22. As can be seen in FIG. 4, insert region 41 is created between the lowermost portion of frame overlay strut 17*b* and panel support means 20, in the absence of an elevated panel ridge at that location, so as to permit sliding reciprocation of a signage panel, such as signage panel 27, into and out of the display region formed thereby.

Figure 5:
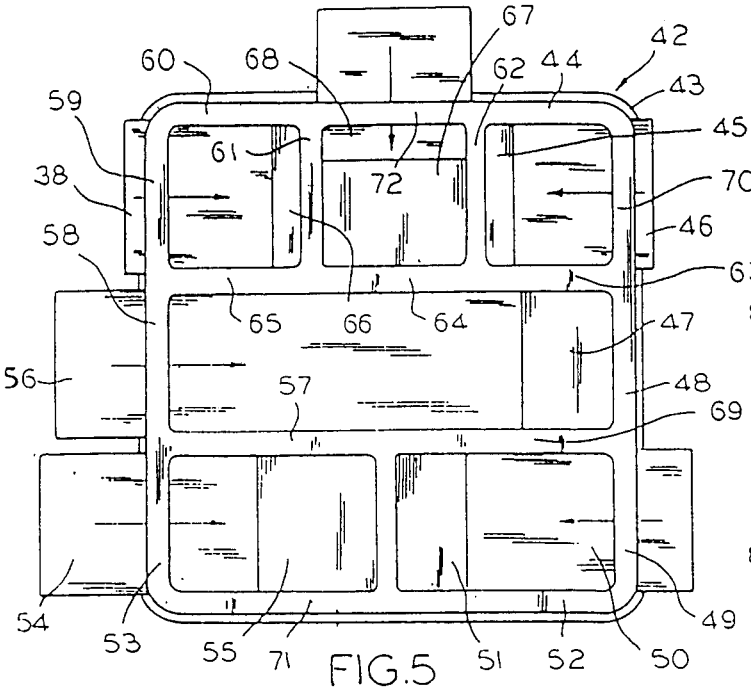
FIG. 5 is a front elevational view of another embodiment of Applicant's modular display apparatus in which a plurality of signage panels are displayed by the apparatus through insertion into same through a plurality of sliding directions.

A plurality of signage panels 46, 56, 67, 54, 50, and 38 are shown in FIG. 5 in a structural embodiment of the modular display apparatus in which the slot insert means described between the frame overlay struts and the panel support means are at varying locations so as to enable the insertion of the various panels through different directions into the apparatus. As can be seen in FIG. 5, for example, the nonabutting or "missing" elevated rigdes would occur immediately below frame overlay struts 49, 53, 58, 59, 72 and 70, with continuously encircling elevated ridges at all other positions under the remaining frame overlay segments—so as to describe insert regions in which, for example, signage panel 46 may be inserted from the right while signage panel 38 is inserted from the left, panel 68 inserted from the top, panel 56 inserted from the left, panel 54 inserted from the left, and panel 50 inserted from the right.

Figure 6:
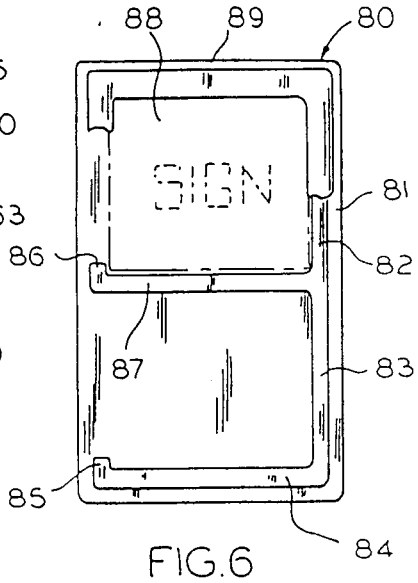
FIG. 6 is a front elevational view of one embodiment of invention disclosing the utilization of shoulder regions acting as insert locking means to preclude inadvertent release of signage panels.
Figure 7:
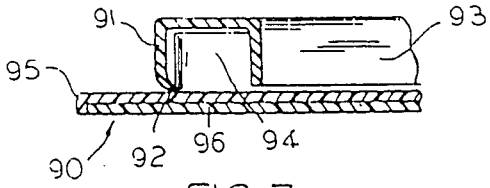
FIG. 7 is an elevated partial cross-sectional view displaying another embodiment of Applicant's invention in which a locking tab serves as an insert locking device to preclude release of the signage panel from its position of insertion.

Regardless of which direction the signage panel is inserted into the apparatus, depending upon the location of the insert slot, the invention further contemplates the utilization of insert locking means such as elevated shoulder region 86 attached to elevated ridge 87 in FIG. 6, as well as elevated shoulder region 85 emanating from elevated ridge 84 in the same figure. As can be seen, once the signage panel is inserted into the display region described by the panel support means 89 and the respective abutting elevated ridges, such as ridges 82 through 84 and 87, the panel is released to slip down into abuttment with its lowermost ridge, e.g. ridge 87, with the shoulder region 86 precluding sliding of the signage panels to the left and out of the region. In an alternative embodiment as shown in FIG. 7, locking tab 92 emanating from overlay frame strut element 91 is capable of snapping back behind a signage panel being slid into the region formed by frame overlay strut 93 covering panel support means 95 in modular display apparatus 90.

Figure 8:
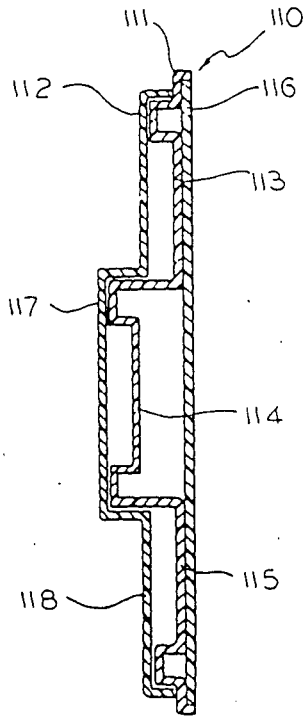
FIG. 8 is an elevated cross-sectional side view of an embodiment of Applicant's modular display apparatus in which the panel support sections and signage panels being displaced thereon are positioned at "staggered" or "stepped" locations in the structure.

In yet another embodiment of the invention a series of "stepped" or staggered positions for the displayed signage panels is described, as shown in FIG. 8 where modular display apparatus 110 has panel support means 113, 114 and 115 at different heights, together with appropriately positioned respective frame overlay members 112, 117 and 118 affixed thereover so as to maintain respective signage panels inserted therewithin in place.

Figure 9:
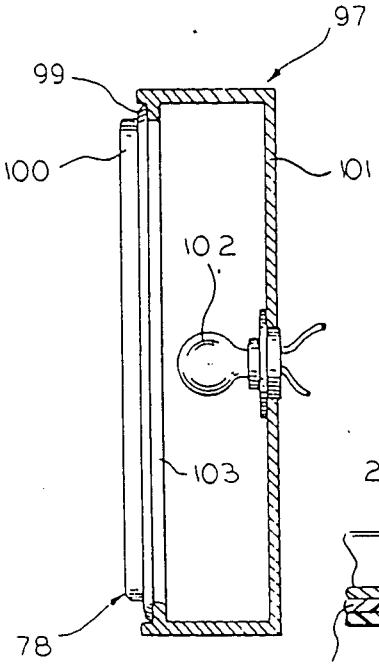
FIG. 9 is an elevated partially cross-sectional side view of another embodiment of the invention in which translucent structural elements are used in combination with background illumination means to create a lighted display medium.
Figure 10:
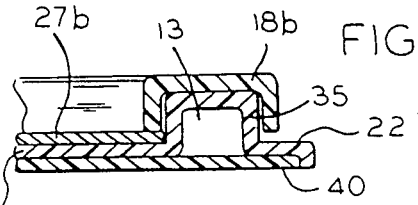
FIG. 10 is an elevated cross-sectional view displaying Applicant's signage panel being maintained in position between the support means, an elevated ridge member and the inner peripheral edge of an aligned U-shaped overlay strut.

In yet another embodiment of the invention, as shown in FIG. 9, it is contemplated that modular display apparatus 78 is formed of component parts such as a back cover plate (not shown), panel support means 99 and signage panels which are substantially constructed of translucent material so as to enable the "back lighting" of the device by illumination means 97—comprising light box 101 with projection bulb 102 and projection aperture 103. In FIG. 10 signage panel 27*b* is shown secured in place and recessed against panel support means 20 while framed by the innermost sides of both elevated panel ridge 35 and overlay frame strut 18*b*. Overlay frame strut 18*b* is aligned with elevated ridge 35, to restrainably maintain signage panel 27*b* in place proximate to panel support means 20, at the innermost peripheral edge of overlay strut 18*b*. Optional back plate 40 is also shown in place behind panel support means 20, so as to nest in flange 22 thereof.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. A modular display apparatus for slidably receiving, supporting, maintaining and, displaying from a front side thereof, one or more substantially flat multi-sided signage panels in a desired orientation, said apparatus comprising;

one or more substantially flat panel support means for positioning behind corresponding ones of said one or more substantially flat signage panels, each of said one or more substantially flat panel support means being of a size substantially equivalent to that of said respective flat signage panel positioned in front thereof, a plurality of elevated panel ridge means operably emanating from said substantially flat panel support means so as to emanate forwardly therefrom, said plurality of elevated panel ridge means positioned to closely follow the outer peripheral shape of said respective signage panel so as to substantially abut and surround all but one of said multitude of signage panel sides, said forwardly emanating portions of said plurality of elevated panel ridge means supporting said respective signage panel along a bottom portion of said signage panel and serving to restrain the position of said respective signage panel positioned therewithin, in a position juxtaposed to said respective panel support means, about all but said one non-abutted side through which slidable reciprocating movement of said signage panel into and out of abutment with said plurality of elevated panel ridge means, is accommodated so as to substantially encircle said signage panel except along said non-abutted side, overlay frame means operably affixable over said substantially flat panel support means, said plurality of elevated panel ridge means, and a peripheral portion of said signage panel, to further restrainably affix and border each one of said one or more signage panels in place against respective ones of said flat panel support means and within respective ones of said abutting elevated panel ridge means, said overlay frame means describing a series of panel aperture means, each aperture means being operably aligned with a respective one of said one or more signage panels so as to operably display indicia borne thereby, through said panel aperture means, said overlay frame means further comprising a series of overlay struts framing each said panel aperture means, each of said overlay struts being of a substantially inverted U-shaped construction having inner and outer peripheral edges and having a front face at the top of said inverted U-shaped construction, each of said overlay struts being in respective operable alignment with each of said plurality of elevated panel ridges so as to telescopically nest thereover, while respectively framing all peripheral sides of each signage panel positioned therewithin and recessing each said signage panel back from the front face of said struts and against said panel support means;

said overlay frame means further creating, at the location of said non-abutted side at which position no elevated panel ridge means occurs, slot insert means formed between said substantially flat panel support means at said location and said corresponding overlay strut positioned thereover, to accommodate insertion, removal and restraint of said signage panel into and from said desired orientation for display, said slot insert means providing access to said signage panel at said non-abutted side between said overlay frame means and said flat panel support means without removal of said overlay frame means in front of said signage panel and without removal or penetration of said flat panel support means behind said signage panel, with said signage panel restrainably interposed between said panel support means along its rear surface, the inner peripheral edges of said overlay struts of said overlay frame means about its periphery at its front surface, and said elevated panel ridge means abutting all but one of said signage panel peripheral sides; and said overlay frame means being restrainably affixed to one or more of said elevated panel ridge means and said panel support means by overlay attachment means.

2. The modular display apparatus according to claim 1 in which the invention further comprises apparatus back cover means, said apparatus back cover means comprising a back panel member operably attached to the rear surface of said substantially flat panel support means towards the improvement of the overall structural rigidity of said display apparatus.

3. The invention according to claim 2 in which said substantially flat panel support means includes a substantially rearwardly facing continuous flange element, said back plate member being capable of being telescopically received by and within said substantially continuous flange member, said back plate member being restrainably affixed in place within said flange member through back plate attachment means.

4. The invention accordingly to claim 1 in which said plurality of elevated panel ridge means are integrally formed with and emanate from a single sheet of panel support material embodying said panel support means, both said panel support means and said elevated panel ridge means emanating therefrom being vacuum-formed from said single sheet of panel support material.

5. The modular display apparatus according to claim 4 in which the invention further comprises integrated overlay frame means fabricated from a single sheet of overlay frame material, said overlay frame means being created through vacuum-forming of said single sheet of overlay frame material.

6. The invention according to claim 1 in which said signage panels, said panel support means, said elevated panel ridge means, said overlay frame means and the aperture means respectively formed therewithin said overlay frame means are of a substantially equivalent rectangular geometric shape respectively.

7. The modular display apparatus according to claim 1 in which the invention further comprises insert locking means for precluding the inadvertent release of said signage panels through and with respective ones of said slot insert means, in the absence of an abutting elevated panel ridge means thereat, said insert locking means comprising an elevated shoulder region rising from the lowermost abutting elevated panel ridge, said elevated shoulder region being positioned substantially proximate to said slot insert means to block release of said respective signage panel after sliding same therepast, so as to restrain said singange panel in place within said modular display apparatus.

8. The modular display apparatus according to claim 1 in which the invention further comprises insert locking means for precluding the inadvertent release of said signage panels through and with respective ones of said insert means, in the absence of an abutting elevated panel ridge means thereat, said insert locking means comprising a locking tab emanating inwardly from the lower side of said overlay frame strut member positioned over said slot insert means, said locking tab means snapping back proximate to said panel support means, behind said respective signage panel, after sliding of same therepast, towards restraining said signage panel in place within said modular display apparatus.

9. The invention according to claim 1 in which said elevated panel ridge about each of said signage panels are substantially continuous in shpae with an interruption in said continuity at said slot insert means, said respective aligned frame overlay means further being continous in shape so as to form a closed frame member about and in front of respective ones of said signage panels while camouflaging said interruption in said aligned elevated panel ridge means at said slot insert means.

10. The invention according to claim 9 in which the depth of said frame overlay means is substantially shorter than that of said elevated panel ridge means so as to permit the nesting of said frame overlay means along the upper region of said respective aligned elevated panel ridge means, while creating said slot insert means at the point of interruption in said substantially continuous elevated panel ridge means, the differences in said depth of said frame overlay means and said elevated panel ridge means being a dimension deep enough to accommodate said sliding receipt of said signage panel therewithin said slot insert means.

11. The invention according to claim 1 in which said overlay attachment means comprising a curable adhesive material interposed between said overlay frame means and one or more of said elevated panel ridge means and said panel support means.

12. The invention according to claim 1 in which said overlay attachment means comprises a plurality of sonic welds between said overlay frame means and one or more of said elevated panel ridge means and said panel support means.

13. The invention according to claim 1 in which said modular display apparatus includes a plurality of flat signage panels, one or more of said plurality of substantially flat signage panels having slot insertion means positioned relative to respective ones of said panel support means so as to enable slidable reciprocating insertion and removal of said signage panel means into and from said modular display apparatus in a plurality of different directions.

14. The invention according to claim 1 in which said modular display apparatus further includes a plurality of signage panels, one or more of said plurality of signage panels being positioned in front of panel support means along different planar depths in said modular display apparatus so as to manifest a stepped display environment.

15. The invention according to claim 1 in which said panel support means and the non-indicia portions of said signage panels are formed of a substantially translucent material, said modular display apparatus further including background illumination means so as to be capable of transmitting light through said translucent panel support means and signage panels thereby manifesting a lighted display environment.

* * * * *

UNITED STATES PATENT AND TRADEMARK OFFICE

CERTIFICATE OF CORRECTION

PATENT NO. : 4,679,341

DATED : July 14, 1987

INVENTOR(S) : Goldman

It is certified that error appears in the above-identified patent and that said Letters Patent is hereby corrected as shown below:

| | |
|---|---|
| Col. 1, line 12 | after "retail" delete "enviroments" and insert instead --environments-- |
| Col. 1, line 20 | after "frame" delete "of" |
| Col. 1, line 34 | after "of" delete "a" |
| Col. 2, line 18 | after "plurality" delete "or" and insert instead --of-- |
| Col. 3, line 43 | after "means." delete "Additonally" and insert instead --Additionally-- |
| Col. 4, line 12 | after "it" delete "accommadates" and insert instead --accommodates-- |
| Col. 4, line 17 | after "are" delete "positoned" and insert instead --positioned-- |
| Col. 4, line 67 | after "being" delete "displaced" and insert instead --displayed-- |

UNITED STATES PATENT AND TRADEMARK OFFICE

CERTIFICATE OF CORRECTION

PATENT NO. : 4,679,341

DATED : July 14, 1987

INVENTOR(S) : Goldman

It is certified that error appears in the above-identified patent and that said Letters Patent is hereby corrected as shown below:

| | |
|---|---|
| Col. 6, line 18 | before "would" delete "rigdes" and insert instead --ridges-- |
| Col. 9, line 15 | after "said" delete "sin-" and insert instead --sign- -- |
| Col. 9, line 16 | before "panel" delete "gange" and insert instead --age-- |
| Col. 9, line 35 | after "in" delete "shpae" and insert instead --shape-- |

Signed and Sealed this

Twenty-sixth Day of January, 1988

*Attest:*

DONALD J. QUIGG

*Attesting Officer*

*Commissioner of Patents and Trademarks*